United States Patent [19]

Minkow

[11] 3,973,516

[45] Aug. 10, 1976

[54] DISPENSING TRAY FOR GLUE MACHINE

[76] Inventor: Julius M. Minkow, 69 Washington St., Brooklyn, N.Y. 11201

[22] Filed: Jan. 14, 1975

[21] Appl. No.: 540,801

[52] U.S. Cl. ..... 118/262

[51] Int. Cl.[2] ..... B05C 1/08

[58] Field of Search ..... 118/258, 259, 261, 262, 118/235; 101/364

[56] References Cited

UNITED STATES PATENTS

| | | | |
|---|---|---|---|
| 2,790,608 | 4/1957 | Sieven | 118/235 X |
| 3,561,357 | 2/1971 | Schinke et al. | 101/364 X |

*Primary Examiner*—John P. McIntosh

*Attorney, Agent, or Firm*—Friedman & Goodman

[57] ABSTRACT

A dispensing tray for a glue machine is described which includes a glue reservoir in fluid flow communication, through an elongate narrow slot, to an open trough which at least partially receives a pickup roller of the glue machine in the operative position thereof. Glue within the reservoir is gradually dispensed through the opening or slot to replace glue which is removed by the pickup roller. The tray is pivotally mounted on the machine to permit movement of the tray from a substantially horizontal position wherein the reservoir and trough are substantially the same levels and a substantially vertical position wherein the reservoir is disposed below the trough for permitting flow of glue from the trough back into the reservoir through the elongate opening. Means are provided for maintaining the tray in the operative position during use of the glue machine and for releasing the same to the filling or storage position subsequent to termination of use of the machine. Movement of the tray to the filling position permits filling of the reservoir through the elongate opening and provides accessibility to the rollers of the glue machine to facilitate the cleaning thereof. A covering member is provided for covering the opening or slot of the reservoir in the storage position of the tray to minimize hardening of the glue within the reservoir during long periods of nonuse.

6 Claims, 5 Drawing Figures

DISPENSING TRAY FOR GLUE MACHINE

BACKGROUND OF THE INVENTION

The present invention generally relates to a gluing machine, and more specifically to a pivotally mounted glue dispensing tray which permits glue in a relatively large reservoir to be gradually released to an open trough for application to a pickup roller and which tray is pivotally movable from an operative to a glue filling position which additionally exposes the rollers of the gluing machine for cleaning.

The improved glue supply tray of the present invention may be utilized with many suitable gluing machines, or other machines which require gradual dispensation of viscous fluid.

Gluing machines generally utilize substantially open trays in which a quantity of glue is added to a sufficient level which assured at least partial immersion of a pickup roller therein. With continued operation of the gluing machine, and after a quantity of glue is removed from the tray, it becomes necessary to refill the tray. With the glue trays of the type utilized in the prior art, it has been necessary to fill the trays with glue to an excessive level to assure that the pickup roller remains immersed within the glue for a much longer period of time before replenishing glue is necessary. Clearly, the provision of a small quantity of glue which only results in minimal immersion or "kissing" of the top surface of glue is not practical since this required constant monitoring and refilling of the glue tray to maintain the necessary level for such minimal immersion.

An additional disadvantage of the conventional glue trays has been that these trays have generally been totally open and the entire supply of glue contained in the tray has been exposed to the atmosphere. This generally tended to cause relatively rapid during up or hardening of the glue within the tray. Subsequent to termination of use of the machine, for this reason, it was in many cases necessary to manually remove all the glue from the tray in order to prevent total hardening thereof which would make subsequent removal particularly difficult. Clearly, this represented considerable effort and time in the maintenance of such glue trays.

An additional disadvantage associated with many gluing machines has been the inaccessibility of the pickup as well as other rollers of the machine for cleaning. In part, this inaccessibility has resulted from the presence and position of the glue tray relative to these rollers. For this reason, it has been necessary, during cleaning the rollers, to remove the tray from the machine and, as mentioned above, to remove the glue from the tray in the process.

Because of the above-mentioned disadvantages, the cold glue trays of the prior art generally could not be left within the glue machine but had to be removed during prolonged periods of nonuse.

One example of a tray arrangement of the type discussed above is described in U.S. Pat. No. 3,204,603. As will become evident from the description that follows, the present invention makes it possible to substitute a glue dispensing tray in accordance with the present invention for the conventional tray disclosed in that patent with minimal modification of the machine.

As will become clear. the glue dispensing tray in accordance with the present invention eliminates the above described disadvantages and offers numerous advantages. Firstly, the subject dispensing tray provides substantially greater glue capacity than heretofore possible. A substantially large reservoir gradually releases sufficient quantities of glue to maintain a relatively low level of glue in an open trough. This level is sufficient for relatively small immersion of the pickup roller within the glue, the glue being slowly replaced from the reservoir at the rate at which it is picked up by the pickup roller. The tray of the present invention provides convenient means for storage of glue over extended periods of time without the glue hardening or becoming unusable. By moving the tray to its filling or non-dispensing position, and covering the opening which communicates the reservoir to the open trough, the glue may be maintained within the reservoir for extended periods of time without having to remove the glue and replace the tray as with prior art trays.

Additionally, although more glue is stored within the tray, less glue is exposed to air than with prior art trays. The reason for this is that a substantial portion of the tray is covered or in the nature of a substantially sealed reservoir, the only open portion being an open trough portion which receives the pickup roller. As suggested above, since less glue is exposed to the air, less glue becomes hardened and the glue is maintained in condition for rapid use as required.

A further advantage of the tray in accordance with the present invention is that glue within the open trough, released from the reservoir, can be maintained at a relatively low level sufficient to be "kissed" by the pickup roller. The regulation of the level of glue in the open trough and the ability to maintain the same at a relatively constant low level permits cleaner operation without getting glue into the roller bearings.

SUMMARY OF THE INVENTION

It is an object of the present invention to provide a glue supply tray which does not have the disadvantages heretofore known in the prior art.

It is another object of the present invention to provide a glue supply tray which is simple in construction and economical to manufacture and which, in many instances, can be readily incorporated into existing machines with minimal modifications by replacing the original glue trays in those machines.

It is still another object of the present invention to provide a glue supply tray which incorporates a substantially sealed reservoir which permits the gradual dispensation of glue into an open trough to permit longer periods of operation of the machine without refilling of the tray.

It is yet another object of the present invention to provide a glue supply tray which provides a regulated or controlled dispensation of glue from a reservoir to an open trough to thereby result in application of glue to the machine pickup roller for greatly extended periods of operation of the machine.

It is a further object of the present invention to provide a glue pickup tray which is pivotally mounted on a glue machine and which permits the glue supply tray to be moved between an upper operative dispensing position and a lower glue filling position which exposes the pickup and other rollers of the machine to facilitate cleaning of the machine rollers.

It is still a further object of the present invention to provide a glue supply tray of the type under discussion which has a substantially greater capacity for the storage of glue which exposing less of the glue to air and to thereby minimize the degree to which the glue hardens.

It is yet a further object of the present invention to provide a glue supply tray as in the last object which permits glue to be stored within the reservoir portion of the tray during periods of nonuse of the machine without removing the glue from the tray.

It is an additional object of the present invention to provide a glue machine having an improved glue supply tray of the type suggested above which includes means for maintaining the glue supply tray in a substantially operative position and which includes locking means for releasing the tray to an inoperative position wherein the rollers of the machine become more accessible and wherein the glue within the open trough of the tray is permitted to flow back into the substantially sealed reservoir of the tray, suitable covering means being provided for covering the opening to minimize exposure to air during extended periods of storage of the glue to prevent hardening of the same.

It is yet an additional object of the present invention to provide a glue supply tray for gluing machines which includes a substantially sealed reservoir and an open trough and an opening in the reservoir which provides fluid flow communication between the reservoir and the open trough to permit a gradual dispensation of glue from the reservoir into the trough to a level sufficient to cause a pickup roller to effectively "kiss" the surface of the glue in the trough.

To achieve the above objects, as well as others which will become apparent hereafter, a glue supply tray in accordance with the present invention which supplies controlled quantities of glue to the pickup roller of the gluing machine comprises a glue supporting surface and an enclosing structure for covering at least a portion of said glue supporting surface, leaving a portion thereof exposed to form an open trough. Said enclosing structure and covered surface portion together form a glue reservoir sealed about said enclosed surface portion with the exception of an elongate opening proximate to said glue supporting surface to provide fluid flow communication between said reservoir and said open trough. Pivoting means is provided for pivotally mounting the glue supply tray on the frame of the gluing machine for movement of said tray between an operative position wherein said glue supporting surface is substantially horizontal and the pickup roller is at least partially received in said open trough proximate to the exposed surface portion for being at least partially immersed in glue within said trough. The glue is permitted to gradually flow from said reservoir into said open trough to replace the glue removed therefrom by the pickup roller. The tray is movable from the operative position to a filling position wherein said glue supporting surface is substantially vertical and glue within said open trough is permitted to flow back into said reservoir through said elongate opening. In this manner, said reservoir may be easily filled and access to the rollers for the purpose of cleaning the same is facilitated. Locking means is provided by maintaining the glue supply tray in the operative position thereof during use of the machine and for releasing the glue supply tray to permit the same to pivot to the filling and storage position thereof subsequent to termination of use of the machine.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

DESCRIPTION OF THE PREFERRED EMBODIMENTS

The present invention is primarily directed to an novel glue dispensing tray for gluing machines. However, the supply tray in accordance with the present invention can equally be utilized to dispense other, preferably viscous, fluids in applications other than gluing machines. As will become evident from the description that follows, the glue supply tray of the present invention need not be utilized with any specific type of glue machine but may be readily adaptable to numerous types of existing gluing machines.

The nature of the specific machine into which the glue supply tray is incorporated is not in and of itself critical, and since the tray cooperates only to a limited degree with the gluing machine, the specific details of the gluing machine and the operation thereof will not be set forth in this application. With the view of shortening the description and avoiding repetition, reference is hereby made to U.S. Pat. No. 3,204,603, issued on Sept. 7, 1965. This patent of the same inventor is for a gluing machine of the type in which the glue supply tray of the present invention has been found to be compatible. Accordingly, the entire description of the gluing machine and the operation thereof set forth in that patent is hereby incorporated by reference. What will be described below, however, will be the modified structural features which accommodate the new glue supply tray of the present invention.

Figure 1:
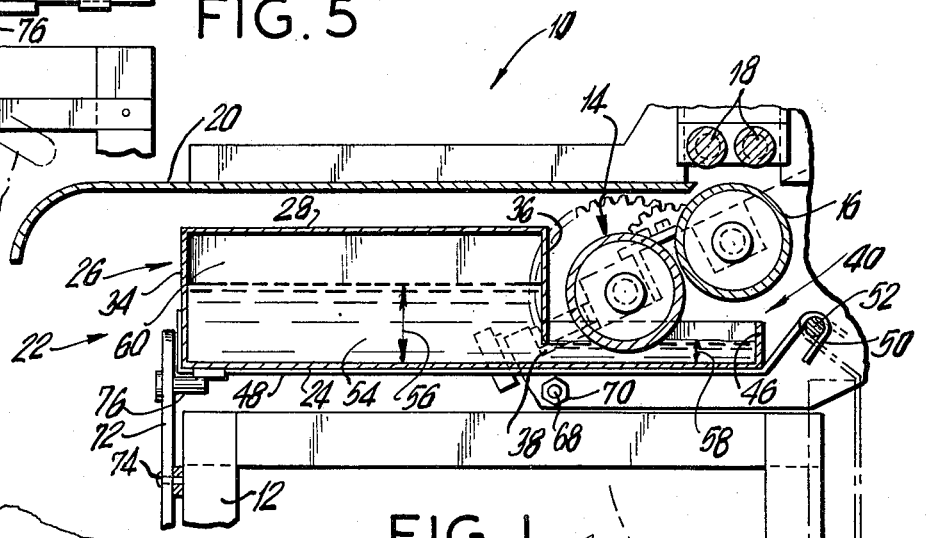
FIG. 1 is a side elevational view, partially in cross section, showing the construction of the glue supply tray in accordance with the present invention and the manner in which the tray is pivotally mounted on a glue machine for movement between an operative dispensing position and a storage or filling position shown in dashed outline.

Referring specifically to the FIGURES, in which similar or identical parts are designated by the same reference numerals throughout, and first referring to FIG. 1, a glue machine is illustrated of the type shown and disclosed in U.S. Pat. No. 3,204,603. The glue machine is designated by the reference numeral 10 and includes a frame 12 which supports the operative elements of the machine.

A pickup roller 14 is provided which is mounted for rotation on a substantially horizontal axis and coupled to a drive train which will not be described in this application but which is fully disclosed in the above-mentioned patent.

An applicator or transfer roller 16 is mounted for rotation about a substantially horizontal axis spaced above the axis of the pickup roller 14 as shown so that the pickup roller 14 is disposed below the applicator roller 16 and only the pickup roller 14 becomes immersed in a supply of glue, as will become evident hereafter. The shafts on which the pickup roller 14 and the applicator roller 16 are movable relative to each other to change the spacing between the rollers, this regulating the thickness of the layer of glue which is applied to the applicator roller for subsequent transfer to a sheet of planar material.

A pair of feed rollers 18, which are movable into substantial tangential relationship with the transfer roller 16, advance or feed an elongate sheet of planar material which is placed on the table 20. Simultaneous actuation of the rollers 14, 16 and 18 causes glue to be picked up from a glue supply tray to be described and a desired thickness or layer of glue to be applied to the advancing sheet of planar material. The operation of the glue machine is more fully described in the above-mentioned patent.

Figure 2:
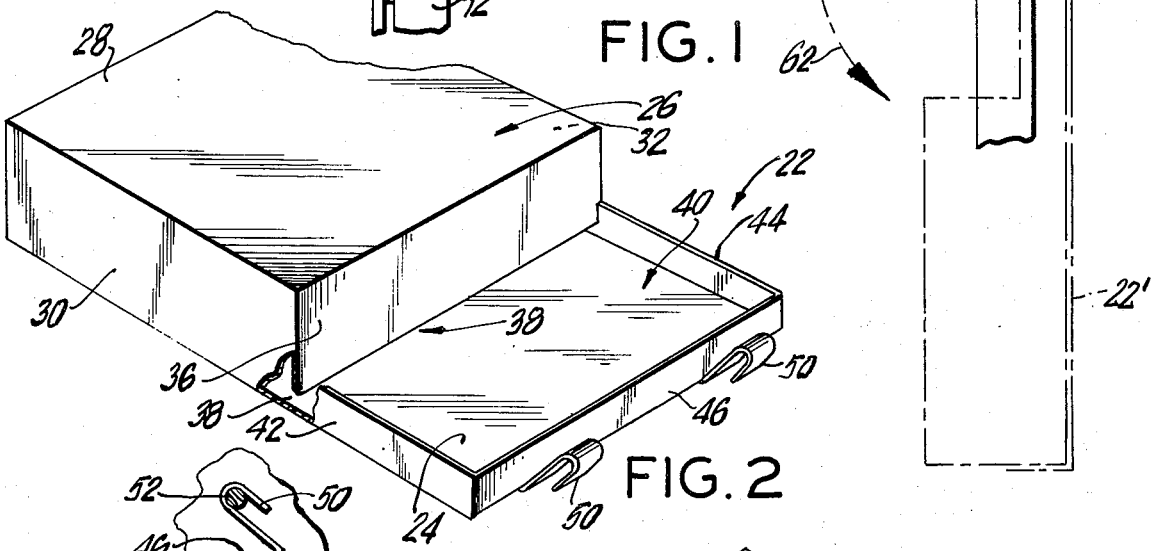
FIG. 2 is a perspective view, partially broken away, of the glue dispensing tray shown in FIG. 1, showing the elongate opening or slot which places the substantially sealed reservoir in fluid flow communication with the open trough.

The gluing machine 10 is shown in FIG. 1 to incorporate the improved glue supply or dispenser tray in accordance with the present invention which is generally designated by the reference numeral 22. The tray is shown in perspective in FIG. 2 and includes a bottom wall 24 having an upper glue supporting surface, as viewed in the FIGURES, whose dimensions generally correspond to the dimensions of the equivalent or corresponding bottom walls of the prior art trays. For this reason, the general overall dimensions of the glue supply tray 22 are comparable to those of the prior art trays which the trays 22 are intended to replace and the trays of the present invention may be incorporated in new machines or can replace existing trays in older machines with minor modifications which will become apparent from the description that follows.

The tray 22 includes a sealed reservoir 26 which includes a top wall 28, side walls 30 and 32, and end wall 34, and an intermediate front facing wall 36.

The top wall 28 is spaced above the bottom wall 24 and the side walls 30, 32 and end wall 34 extend between the bottom and top walls 24, 28 respectively to form an air tight seal where these walls are joined. The intermediate wall 36, however, extends downwardly from the top wall 28 a distance less than the spacing between the top and bottom walls to form an elongate opening, slot or space 38. The reservoir thereby is totally sealed with the exception of the opening or slot 38.

The exposed portion of the bottom wall 24, which is not covered by the reservoir enclosure walls, forms an open trough 40 which includes side walls 42 and 44 and front wall 46. The walls 40, 42 and 46 are of the same height and form a peripheral wall about the exposed bottom wall portion. The height of the peripheral wall of the open trough 40 is greater than the height of the gap or opening 38 but less than the height of the side walls 30, 32 and end wall 34.

As best shown in FIG. 1, the elongate opening or slot 38 provides fluid flow communication between the sealed reservoir 26 and the open trough 40. By filling the sealed reservoir with glue or some other viscous fluid, the glue or fluid may be gradually dispensed through the opening 38 at a rate which is advantageously selected to maintain the level of the glue within the open trough 40 at a substantially constant value substantially independently of the rate at which the glue or other fluid is withdrawn, such as by the pickup roller 14.

Figure 3:
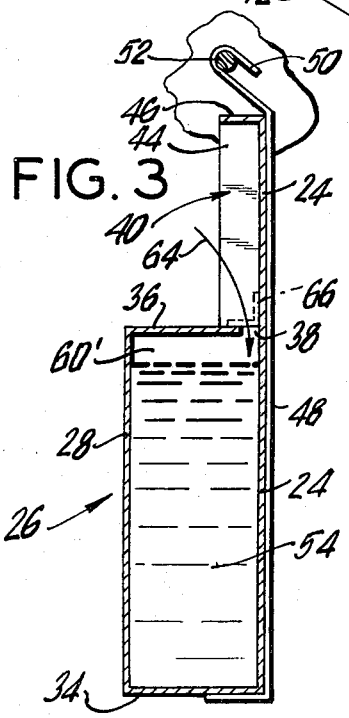
FIG. 3 is a side elevational view of the tray shown in FIG. 1, in cross section, shown in the storage or filling position, the arrow suggesting the manner in which the reservoir is filled and also showing in dashed outline a covering member in the nature of an L-shaped bar for closing the elongate opening of the reservoir to minimize air exposure of the glue.

The manner of mounting the tray on the glue machine will now be described. Two elongate straps 48 are spaced from each other and extend in substantially parallel relationship along the length of the bottom wall 24 as shown in FIGS. 1 and 3. The ends of the straps 48 extend beyond the front wall 46 and are configurated to form hooks 50 as shown which are adapted to be mounted on a rod or pivot pin 52 fixedly mounted on the frame 12 of the glue machine.

An important feature of the present invention is the ability to pivotally move the tray 22 between an operative position shown in FIG. 1 wherein the glue supporting bottom wall 24 is substantially horizontal and the pickup roller 14 is at least partially received in the open trough 40 for being at least partially immersed in glue 54 within the open trough. The glue 54 is permitted to flow from the sealed reservoir 26 into the open trough 40 to replace glue 54 removed therefrom by the pickup roller 14.

Referring to FIG. 1, the glue 54 is shown to be at a level 56 within the sealed reservoir 26 and to a substantially smaller level 58 within the open trough 40. It is believed that the difference in the levels 56 and 58 is at least partially determined by the barometric principle, the degree of vacuum which is achieved within the reduced pressure space 60 above the glue in the reservoir 26, and the height of the opening 38. It is at least partially for this reason, that the levels 56 and 58 do not equalize, particularly when viscous fluids are utilized, due to the difference between the reduced pressure in the space 60 and the atmospheric pressure above the open trough 40.

The tray 22 is pivotally movable about the rod 52 as suggested by the arrow 62 to a storage or filling position shown in dashed outline 22' in FIG. 1 and shown in FIG. 3. In the filling or storage position, the bottom wall 24 is substantially vertical and glue which had flowed from the reservoir 26 into the open trough 40 is permitted to flow back into the reservoir through the elongate opening 38. In this position, additional glue may be added, as suggested in FIG. 3 by the arrow 64.

Advantageously, the reservoir 26 is totally filled to bring the level of the glue up to the intermediate wall 36 and the opening or space 38. While this is not necessary, filling of the reservoir prior to movement to the operative position shown in FIG. 1 assures maximum reduced pressure in the space 60. However, it is not necessary to refill the reservoir 26 subsequent to each period of nonuse of the tray. When the reservoir 26 is not fully filled to thereby form a space 60' containing air, as shown in FIG. 3, movement of the tray to the operative position shown in FIG. 1 results in a partially reduced pressure in the space 60 which in most instances is sufficient to provide satisfactory levels 58 within the open trough 40.

As should be clear from the above description, movement of the tray 22 from the operative to the filling positions improves the access to the rollers 14 and 16, this facilitating cleaning of the rollers.

Figure 4:
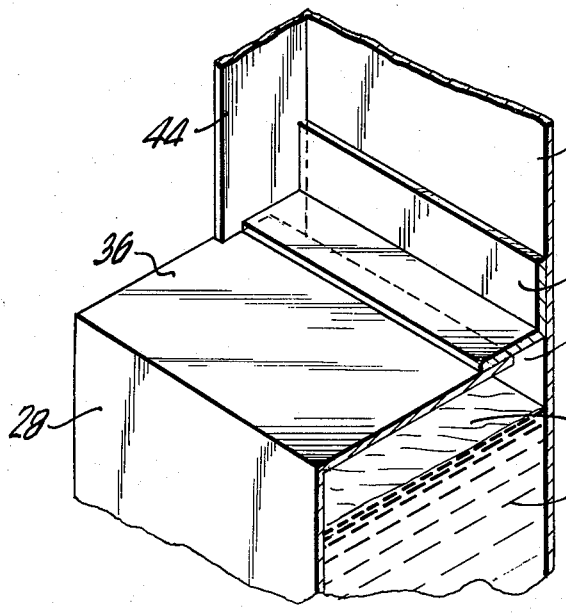
FIG. 4 is an enlarged perspective view of the tray shown in FIG. 3, shown in cross section, showing the details of the elongate slot and the manner in which the L-shaped bar covers the slot to prevent exposure to air and hardening of the glue during extensive periods of nonuse.

A further important feature of the present invention is that the glue 54 must not be removed from the tray subsequent to each use of the machine for those periods of time when the machine is not used. As suggested above, movement of the tray 22 to the filling position 22' causes the glue within the open trough 40 to flow back into the reservoir 26 through the opening 38. Subsequent to such free return flow, only a small quantity of glue remains on the exposed portion of the bottom wall 24 which must be cleaned. The glue which returns into the sealed reservoir 26 is minimally exposed to air and therefore the glue 54 may be left in the reservoir for extended periods of time without hardening. To still further minimize the exposure to air, suitable cover means such as an L-shaped bar 66 shown in FIGS. 3 and 4 may be utilized to cover the opening or slot 38 during periods of nonuse. Other suitable means may be utilized to cover the opening subsequent to return of the substantial part of the glue through the opening or into the reservoir.

Any suitable locking means may be provided for maintaining the glue supply tray 22 in the operative position thereof shown in FIG. 1 during the use of the machine and for releasing the glue supply tray to the filling position 22' as described above subsequent to termination of the use of the machine. The specific nature of the locking means is not critical for the purpose of the present invention, it only being desirable that locking and releasing of the tray be simple and convenient to permit rapid and repeated movements of the tray to the desired positions thereof.

In the presently preferred embodiment, the locking means includes a rod 68 which is mounted on the frame 12 and which has a retaining or supporting portion or free end thereof which is positionable below the bottom wall 24. A lock nut 70 fixes the position of the rod 68 in the desired supporting position of the rod.

Figure 5:
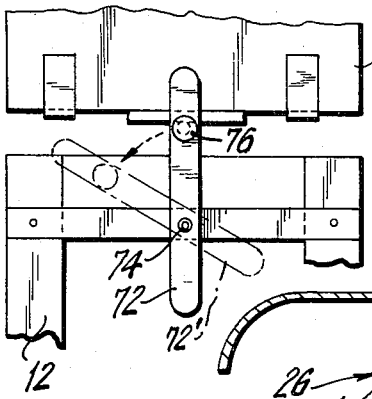
FIG. 5 is an end elevational view of the tray shown mounted on a machine frame, showing a pivotally mounted lever or arm on the frame which is movable between supporting and releasing positions of the tray to support the tray during use of the machine and for releasing the tray for movement to the storage or filling position during nonuse of the machine.

As an additional or alternate method of locking the tray 22, there is shown in FIGS. 1 and 5 a pivotally mounted arm 72 pivoted about a pin 74 having a free end which substantially extends from the frame to the region of the bottom wall 24 in the operative position of the tray. A protruding support member of supporting portion 76 is positionable below the bottom wall 24 when the arm 72 is pivoted to its vertical position as shown in FIG. 5. To release the tray and to move the same to the filling or storage position, the arm is pivotally rotated or turned about the pivot pin 74 in a clockwise or counter-clockwise direction to remove the necessary support for maintaining the tray 22 in the operative position.

As should be clear from the above description, the glue supply tray in accordance with the present invention, which is suitable for use with numerous gluing as well as other types of machines where gradual dispensation of liquids is desirable, provides increased storage of glue to be dispensed since the reservoir rises above the walls 42, 44 and 46, and the height of the sealed reservoir 26 may be increased to extend up to the table 20 if this is necessary. In addition to the greater glue capacity, the glue tray 22 serves as a reservoir for storage of glue with minimal exposure to air which has, in the prior art, caused a problem of hardening of glue. With the present tray, the glue may be retained in the tray for repeated use without the need to fully clean and remove all the glue from the tray subsequent to each period of use.

Because the reservoir 26 is substantially sealed, reduced pressures are achievable within the reservoir above the glue level, the reduced pressure within the reservoir permitting controlled levels of glue within the open trough. Advantageously, the level 58 is approximately equal to the height of the elongate opening or slot 38. As mentioned above, by maintaining the level 58 at a substantially constant value which is approximately equal to the height of the slot, the pickup roller 14 is permitted to substantially "kiss" the top surface of the glue in the open trough 40. Such an arrangement provides improved application of glue to the pickup and applicator rollers without immersing the pickup roller in glue to an excessive degree.

Additionally, as mentioned above, the facility with which the tray 22 is pivotally moved to the position 22' provides substantially improved access to the rollers, this facilitating cleaning thereof. Because the tray 22 is movable to a region remote from the rollers, this leaves space beneath the rollers for the positioning of an additional tray, similar to prior art trays, which may be filled with a cleaning fluid such as water. By thereby moving the tray 22 out of the way and substituting a tray with cleaning fluid in place thereof, the pickup roller 14 may be submersed within the cleaning fluid to clear the rollers of the glue machine by operation thereof.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A glue supply tray for supplying glue to a glue machine generally of the type having a pickup roller at least partially immersible in a supply of glue, said glue supply tray comprising a substantially sealed reservoir and an adjacent open trough, a bottom wall of said trough extending from a bottom wall of said reservoir to provide a continuous inner bottom surface therewith, one side wall of said trough extending from one side of said reservoir to provide one continuous inner side surface, an opposite side wall of said trough extending from an opposite side wall of said reservoir to provide a continuous opposite inner side surface, said reservoir having opposite end walls and a top wall to provide a sealed enclosure with one of said end walls being disposed adjacent to said trough, said trough having an end wall to provide an open receptacle for the glue, said enclosure having a height greater than height of said trough to permit a substantial quantity of glue to be stored within said enclosure for gradual release of the glue from said reservoir into said trough, an edge of said one end wall of said reservoir being spaced from said inner bottom surface across its width from said one inner side surface to said opposite inner side surface to provide opening means for unrestricted glue flow communication between said reservoir and said trough along said inner bottom surface, said opening means defining an elongate opening, hook means integrally connected to said trough for pivotally mounting said tray on a pin horizontally mounted on a frame of the glue machine for movement of said tray between an operative position and a filling position and for permitting said tray to be mounted on and removed from the glue machine, said operative position providing for said sealed reservoir and trough to be substantially at the same horizontal level and for the pickup roller to be at least partially immersed in the glue within said trough so that the glue is permitted to flow from said sealed reservoir into said open trough to replace any glue removed therefrom by the pickup roller, said filling position providing for said sealed reservoir to be disposed substantially vertically below said trough and for the glue within said trough to flow back along said inner bottom surface into said sealed reservoir through said elongate opening and to permit said sealed reservoir to be easily filled and access to the rollers to be facilitated for the purpose of cleaning the same, and locking means for maintaining the glue supply tray in said operative position during use of the machine and for releasing the glue supply tray to permit the same to pivot to said filling position subsequent to termination of use of the machine.

2. A glue supply tray as defined in claim 1, wherein said hook means includes two spaced apart hooks connected to said trough adjacent to said trough end wall.

3. A glue supply tray as defined in claim 1, wherein at least one strap is connected to said bottom wall and extends along a length direction of said tray, said hook means forming a part of a free end of said strap.

4. A glue supply tray as defined in claim 1, wherein said locking means comprises a rod mounted on the frame of the glue machine including a retaining portion movable in horizontal directions and disposed at a height proximate one of said bottom walls in the operative position of said tray, said retaining portion being movable below said one bottom wall to support said tray and being retractable to a position lateral of said tray to permit pivotal movement of said tray from said operative position to said filling position.

5. A glue supply tray as defined in claim 1, wherein said locking means comprises an arm pivotally mounted on the frame of the glue machine and having a retaining portion at one free end thereof, said arm being mounted for pivotal movement to bring said retaining portion below and in supporting relationship to said reservoir bottom wall in one position thereof and to another position thereof wherein said retaining means is remote from said reservoir bottom wall.

6. A glue supply tray as defined in claim 1, further comprising cover means for covering said opening in a storage position of the tray, whereby the glue is minimally exposed to air during storage.

* * * * *